US011805880B2

(12) United States Patent
Morris

(10) Patent No.: US 11,805,880 B2
(45) Date of Patent: Nov. 7, 2023

(54) HAIR TOOL CASE

(71) Applicant: Ashanta Morris, North Hollywood, CA (US)

(72) Inventor: Ashanta Morris, North Hollywood, CA (US)

(73) Assignee: Ashanta Morris, North Hollywood, CA (US)

( * ) Notice: Subject to any disclaimer, the term of this patent is extended or adjusted under 35 U.S.C. 154(b) by 323 days.

(21) Appl. No.: 17/031,299

(22) Filed: Sep. 24, 2020

(65) Prior Publication Data

US 2022/0087380 A1 Mar. 24, 2022

(51) Int. Cl.

| | |
|---|---|
| ***A45C 7/00*** | (2006.01) |
| ***A45C 5/00*** | (2006.01) |
| ***A45D 44/02*** | (2006.01) |
| ***A45C 13/10*** | (2006.01) |
| *A45D 1/00* | (2006.01) |

(52) U.S. Cl.

CPC ..... *A45C 5/005* (2013.01); *A45C 7/0095* (2013.01); *A45C 13/1046* (2013.01); *A45D 44/02* (2013.01); *A45C 2007/0004* (2013.01); *A45D 2001/002* (2013.01)

(58) Field of Classification Search

CPC ..... A45D 1/00; A45D 2001/002; A45D 2006/005; A45C 2007/0004; A45C 2007/70095; A45C 11/008

See application file for complete search history.

(56) References Cited

U.S. PATENT DOCUMENTS

| | | | | |
|---|---|---|---|---|
| 5,638,955 A * | 6/1997 | Calciano | A45D 20/12 383/110 |
| 6,068,122 A * | 5/2000 | Burns | A45D 1/00 206/372 |
| 2011/0284397 A1* | 11/2011 | Batres | A45C 11/24 150/120 |
| 2018/0103744 A1* | 4/2018 | Moore | A45D 1/00 |
| 2018/0249802 A1* | 9/2018 | Aizenberg | A45C 7/0095 |

* cited by examiner

*Primary Examiner* — Mollie Impink
(74) *Attorney, Agent, or Firm* — Perkins Coie LLP

(57) ABSTRACT

Systems and devices for the safe storage and transport of hair styling equipment is provided via a hair tool case. The hair tool case protects hair tools, and their power cords, from damage during storage and stowing. The hair tool case has a plurality of sleeves to that are configured to hold styling tools, along with a plurality of straps to affix the tools in place within the sleeves. The hair tool case can further have a series of cable clips, to clip the power cords in place, and a plurality of hooks to hold the power tools. A flap can be provided to cover the power cords, and the case is configured to have the flaps envelop the cables, and have the sleeves fold onto the flaps to provide protection to all of the styling tools.

20 Claims, 8 Drawing Sheets

HAIR TOOL CASE

TECHNICAL FIELD

Various embodiments of the present disclosure generally relate to cases that can be used to protect and carry hair styling tools.

BACKGROUND

Hair stylists use a wide array of tools to style hair. In any given styling session, a stylist may need to use, for example, a curling iron or a straightener. These tools have very hot exposed metal parts, which are heated via electric power provided by an AC power cord. This causes a situation where the tool has a very hot and exposed metal portion that is hot enough to melt plastic, but also a plastic portion which can easily melt if it comes into contact with the metal portion.

A melted power cord not only causes economic damage to the stylist, but it also creates a safety hazard to both the stylist and the stylist's client. A melted power cord will typically result in an exposed wire. To avoid injury to the stylist or the stylist's client, the stylist will need to fix this exposed wire. If the exposed wire cannot be fixed, the hair tool will need to be disposed of. Trying to fix and replace hair tools is costly to the stylist, and results in a big repair distraction.

In addition, a styling tool with an exposed wire is a safety hazard. Oftentimes, a stylist may not notice an exposed wire, and may plug it in and use the tool. The exposed wire will have a significant amount of power running through it from the AC outlet and the exposed wire becomes a significant safety hazard. If anyone touches the exposed wire during use, they risk significant injury.

Stylists frequently need to store, transport, and access their tools many times a day, and they need multiple tools to perform their job. Stylists frequently swap tools in and out of storage in any given day. Further, stylists need to travel to different locations and take their tools with them.

Prior art systems do not allow for the safe storage and transport of hair styling tools. Many stylists dump their tools in bags, but this can cause a cord to come in contact with hot metal.

Prior art systems cause damage to tools and, can oftentimes create dangerous working conditions.

SUMMARY

This document relates to systems and methods for the safe and proper storage of hair styling tools.

In an embodiment, a hair tool is provided that comprises a first and second pad, wherein the first pad and second pad are connected to each other and are configured to be foldable onto each other. The hair tool has one or more tool sleeves that are attached to the second pad where each of the one or more tool sleeves are configured to house a hair tool. The hair tool further has a first flap and a second flap attached to the first pad, wherein the first and second flap are configured to be folded over to cover the second pad and the first pad when the second pad is folded over the first pad, wherein one end of the first flap is configured to be attached to one end of the second flap. The hair tool case further has a strap on the outside of the one or more tool sleeves and one or more cable clips attached to the second pad. The hair tool case further has one or more cable hooks attached to the first pad.

In a further embodiment, the hair tool case's strap is attached to the strap at portions in between each of the one or more tool sleeves. In a further embodiment, the one or more cable clips are attached to the second pad near an end portion of the one or more tool sleeves. In yet another embodiment, each of the one or more cable hooks are configured to accommodate a wrapped cable wire. In yet another embodiment, the first pad is made of vinyl and the second pad is made of leather. In yet another embodiment, the first flap and the second flap are made of leather. In yet another embodiment, the one end of the first flap is configured to be attached to the one end of the second flap via a leather lace and the one or more tool sleeves each have a single opening on one end, wherein the other end is closed.

As will be realized, embodiments of the disclosure are capable of modifications in various aspects, all without departing from the scope of the present disclosure. Accordingly, the drawings and detailed description are to be regarded as illustrative in nature and not restrictive.

Figure 1:
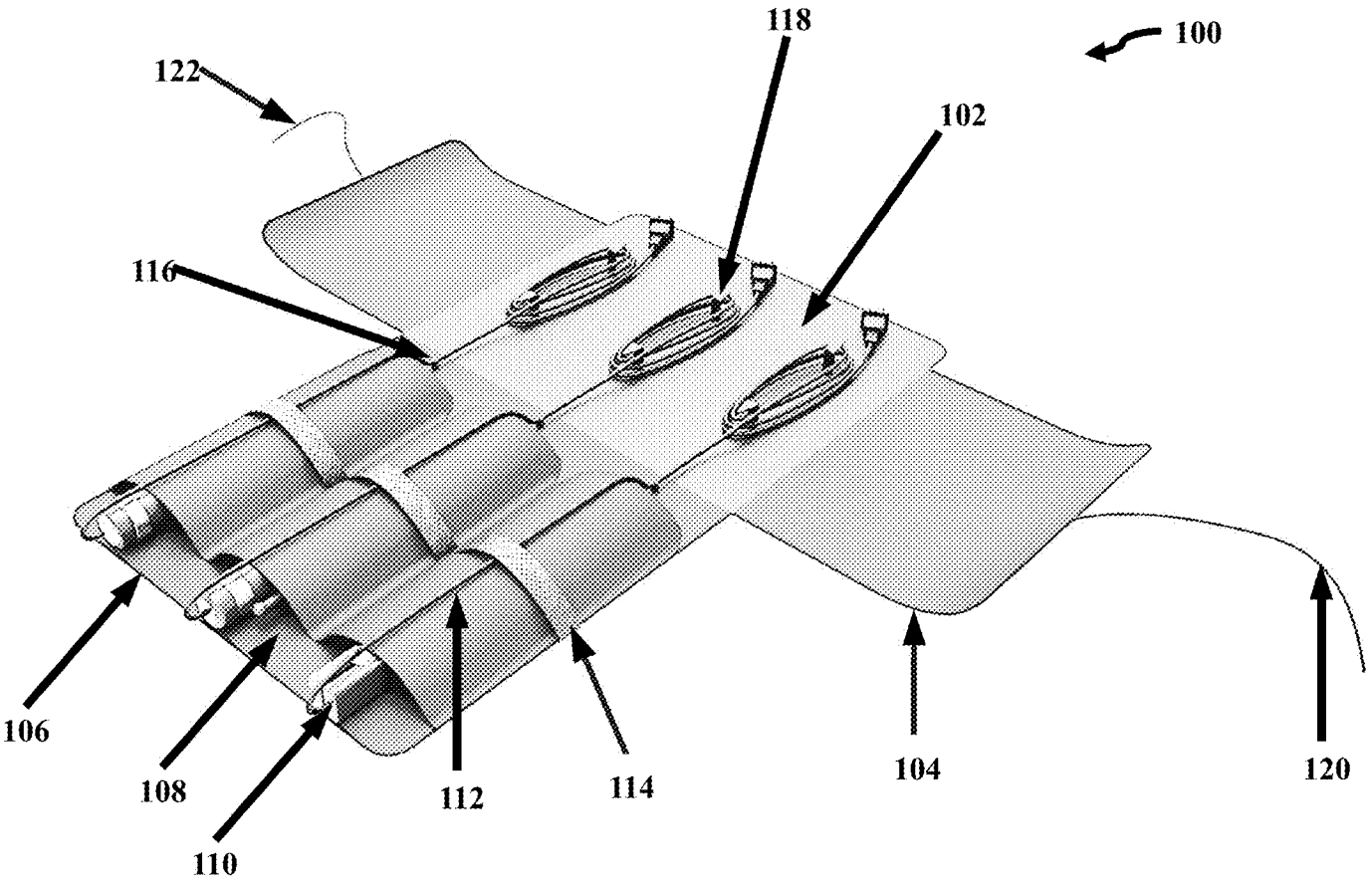
FIG. 1 illustrates an overhead side view of an exemplary hair tool case.

While embodiments of the present disclosure are amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The present disclosure generally relates to a carrying case for the safe storage and stowing of hair tools. Throughout a styling session, hair stylists often use and access many various tools such as hair straighteners, hair curlers, texture irons, and other tools that require heat to work. These tools are typically heated through electric power from an AC outlet.

Hot hair tools create a both a safety hazard and a damage risk to tools. Hot hair tools can damage non-metallic portions of other hair tools, or can cause damage to the power cord that connects the hair tool to the AC outlet. Damaged power cords leave exposed wires, and these exposed wires create safety hazards. Damaged hair tools need to replaced or repaired. This results in a cost and waste of time to the stylist.

Embodiments of the present disclosure provide for the safe storage and stowing of hair tools. The safe storage and stowing of hair tools given by the present disclosure protects hair tools from damage. This saves time and money to the stylist, and also reduces the safety hazard that damaged wires may cause.

Shown in FIG. 1 is an overhead side view of an embodiment of the hair tool case 100. The hair tool case 100 has a first pad 102, flaps 104, and a second pad 106. The first pad 102 can be made of vinyl, and the flaps 104 and the second pad 106 can be made of leather.

The hair tool case has one or more tool sleeves 108 attached to the second pad 106. The tool sleeves are used to house one or more hair tools 110. The hair tools 110 can be one or more tools, such as hot irons, straighteners, curlers, or any tool known in the art. Furthermore, it is not necessary that the tool sleeves 108 be used to carry hot hair tools. In an embodiment, the tool sleeves 108 are designed in various sizes to accommodate other types of tools, such as brushes, clips, or any other tool known in the art. Further, although the tool sleeves 108 are depicted as being similar to each other, it should be understood that each tool sleeve 108 can be of a different size or shape. In addition, although three tool sleeves 108 are depicted, any number of tool sleeves 108 can be used.

The hair tool sleeves 108 act to house a hair tool 110 so that its metal portion, which is frequently heated through use, is covered to protect the hair tool 110's other components from heat. This further protects other hair tools 110 from heat. The hair tool sleeves 108 can be made of leather, or any other material that insulates from heat. In an embodiment, the hair tool sleeve 108 is designed to accommodate a hair tool that does not emit heat, e.g., a brush, and it is made out of material that does not insulate from heat, e.g., a canvas.

The hair tool sleeves 108 are affixed to the first pad 102. In another embodiment, the hair tool sleeves 108 are removably attachable to the first pad 102.

The hair tool sleeves 108 have a single opening, where the lower portion of the hair tool sleeve is closed to prevent the hair tools 110 from slipping through. In another embodiment, the hair tool sleeves 108 have multiple openings.

As illustrated in FIG. 1, the hair tool 110 fits into the hair tool sleeve 108 so that the metal portion is enclosed by the hair tool sleeve 108. In this configuration, the power cord 112 can be wrapped over and around the tool sleeve 108.

To keep the power cord 112 in place, and prevent it from becoming tangled or unmanageable, the hair tool 100 provides additional organizational mechanisms. A strap 114 is provided to affix the power cord 112 in place. In an embodiment, the strap 114 is fixably attached to the second pad 106 in between each tool sleeve 108. The strap 114 is leather, but it should be understood that any material can be used. In an embodiment, the strap 114 is removably attachable. In another embodiment, the hair tool case 100 lacks a strap 114.

The hair tool case 100 also has cable clips 116 that are attached to the first pad 102 below the tool sleeves 108. The cable clips 116 allow the power cord 112 to be removably clipped to it. This allows the power cord 112 to be affixed in place. Furthermore, the cable clips 116 allow the power cord 112 to be affixed in place when the hair tool case 100 is folded for transport. In an embodiment, the hair tool case 100 lacks cable clips 116. In another embodiment, not every tool sleeve has a corresponding cable clip; any number of cable clips can be provided.

The hair tool case 100 further has cable hooks 118 that allow the power cord 112 to be wrapped to further reduce clutter and further prevent the power cord 112 from becoming tangled and lessen the chance that it will come in contact with hot metal. As demonstrated in FIG. 1, the power cord 112 can wrap around the cable hooks 118 multiple times. In an embodiment, cable hooks 118 are not provided, and another cable clip 116 is provided in the same location. In another embodiment, cable hooks 118 are not provided, and another type of attachment mechanism is provided. In yet another embodiment, no cable hooks 118 are provided. In another embodiment, not every tool sleeve has a corresponding cable hook; any number of cable hooks can be provided. For example, in an embodiment, one tool sleeve 118 is designed to house a tool that does not use power and does not have a cord; in this instance, a cable hook 118 and cable clip 116 are not provided.

As can be appreciated, the cable hooks 118, and cable clips 116, affix the power cords 112 in place when the hair tool case 100 is folded for stowing. By safely stowing the hair tools 110, and their power cords 112, the hair tool carrying case 100 prevents loose power cords 112 from coming into contact with hot portions of the hair tools 110, and prevents tangling of the power cords 112.

After the hair tools 110 have been stowed into the tool sleeves 108, and after the cord 112 has been secured by the strap 114, the clip 116, and cable hooks 118, the second pad 102 can be folded onto the first pad.

To secure everything in place, the hair tool case 100 has flaps 104 that can fold onto and envelop the second pad. The flaps 104 have a piece of leather lace 120/122 attached to their ends. The leather lace can be used to tie everything together to secure everything within the hair tool case 100.

The hair tool case 100 advantageously keeps all hair tools safe and secure. It prevents damage to hair tools, and reduces the possibility that cords could tangle. The hair tool case 100 allows a stylist to more quickly, and safely, do their job. By safely securing hair tools 110, the hair tool case 100 prevents possible hazards from unnoticed and exposed cords 112. The hair tool case 100 also reduces economic damage to the stylist by protecting their tools from damage.

Although the hair tool case 100 has be illustrated as having three hair tool sleeves 108, it should be understood that this demonstration is merely exemplary, and any number of hair tool sleeves 108 can be used. Further, although certain pieces have been described as being leather or vinyl, it should be understood that any type of materials can be used. In addition, the leather lace 120/122 can be any type of attachment mechanism, whether it be a clip on, or magnetic, or anything that allows the two flaps 104 to be tied together.

Although leather and vinyl are described, it should be understood that any type of material can be used. For example, the hair tool case can have a heat resistant inner lining, then a canvas exterior. The hair tool case can be made up of all leather, or all vinyl, or any combination thereof. It should also be understood that the materials described are merely exemplary, and any combination of materials can be used.

Further, although a single component of the hair tool case has been described as a single integrated component, it should be understood that the component can be comprised of multiple materials, or multiple subcomponents.

Figure 2:
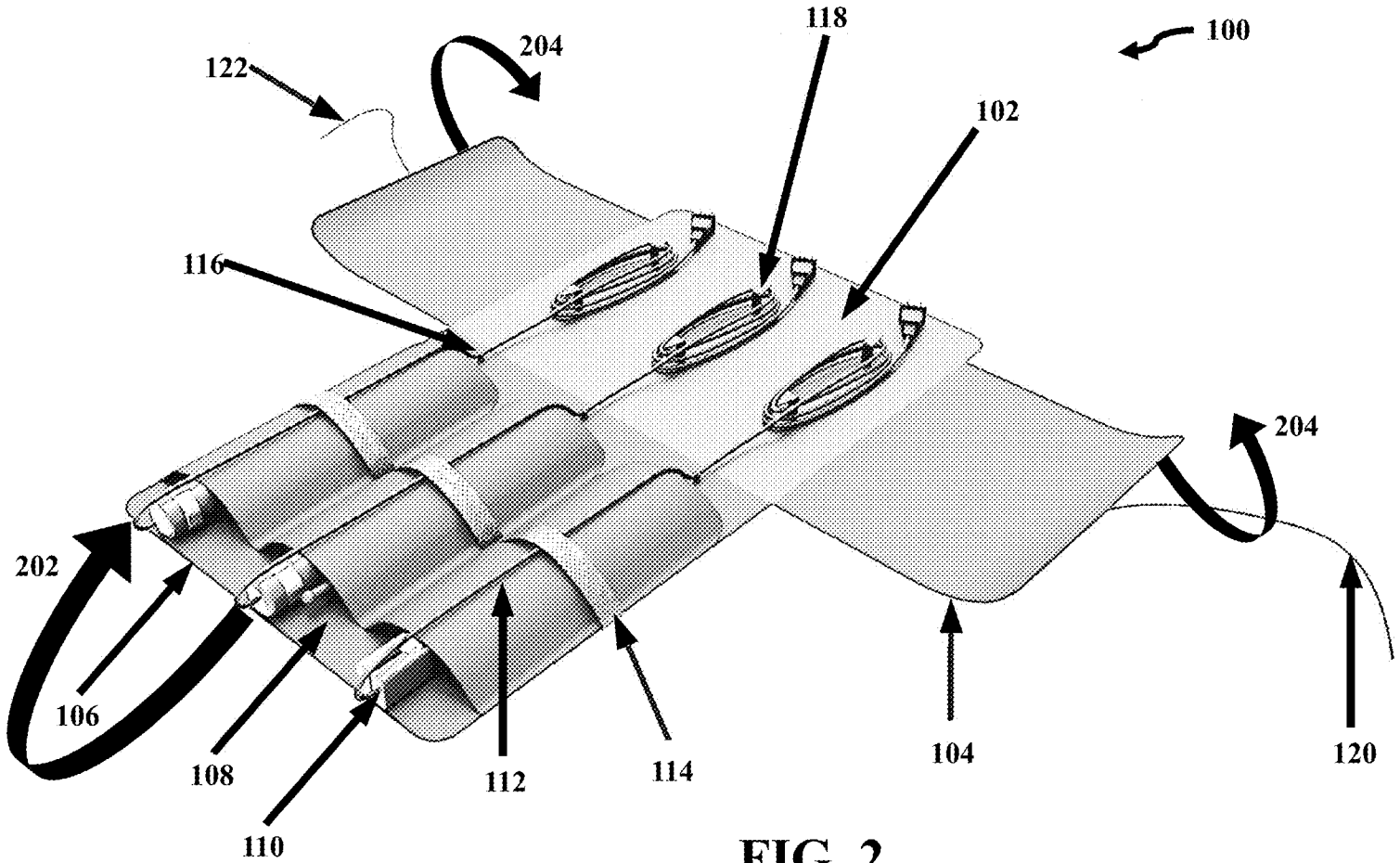
FIG. 2 illustrates an overhead side view of an exemplary hair tool case demonstrating how it is foldable.

Shown in FIG. 2 is another view of the hair tool case 100, with like-annotations from FIG. 1. After the hair tools 110 have been properly stowed, pad 106 is folded onto pad 102. This is demonstrated via arrow 202. After, the two flaps 104 are folded inwards as denoted with arrows 204, then the two flaps 104 are tied together with the leather lace 120/122.

Figure 3:
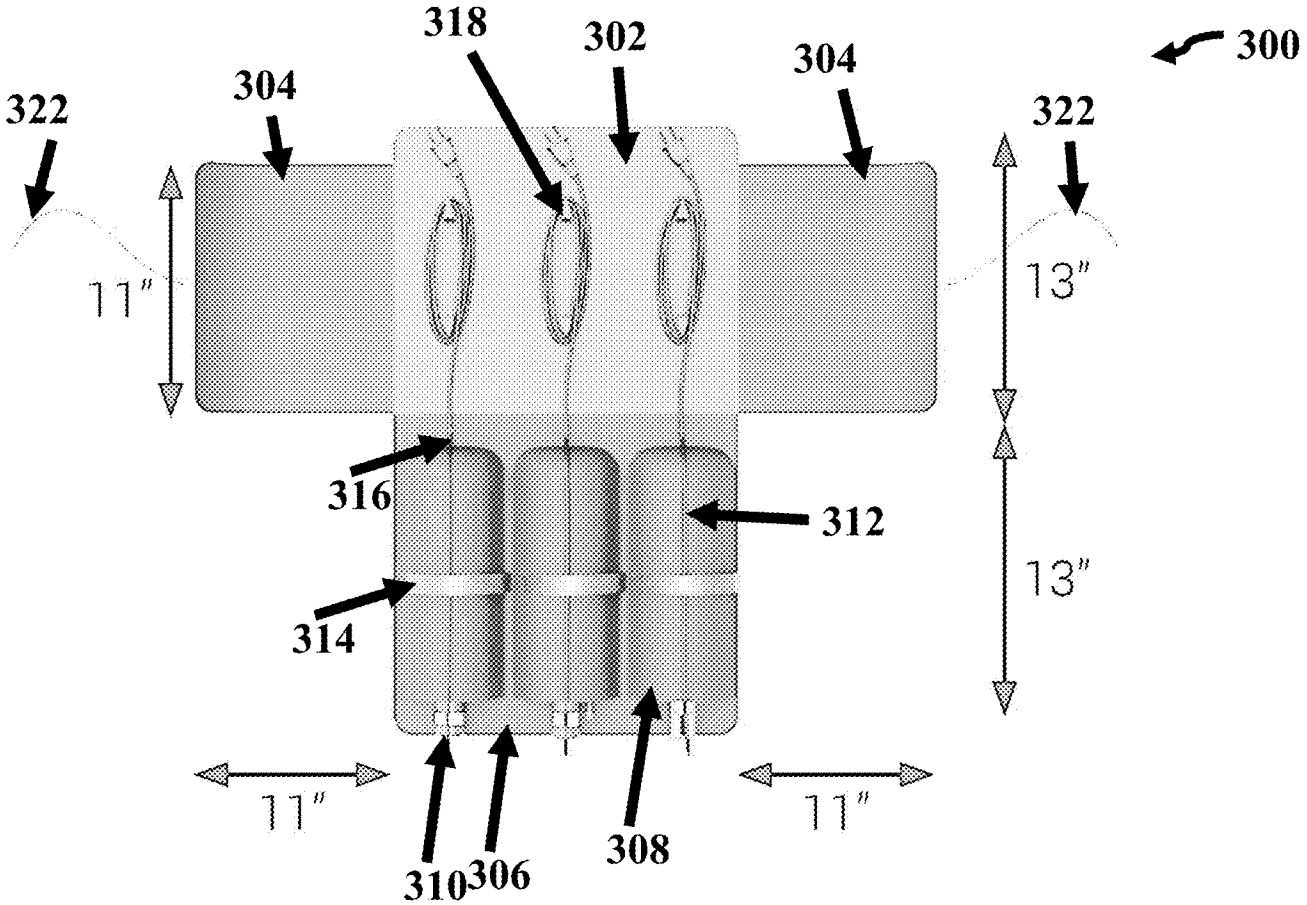
FIG. 3 illustrates an overhead view of an exemplary hair tool case.

Shown in FIG. 3 is an exemplary overhead view of the hair tool case 300. FIG. 3 is similar to FIG. 1 but of a different perspective. As shown in FIG. 3, the hair tool case 300 has a first pad 302, flaps 304, a second pad 306, tool sleeves 308, hair tools 310, power cords 312, straps 314, cable clips 316, cable hooks 318, and leather lace 320/322.

As shown in an embodiment, the flaps 304 can be a square and can have dimensions of 11 inches. The first pad 302 and second pad 306 can also be squares and can have dimensions of 13 inches. These sizes are only exemplary, and it should be understood that any size or shape for the pads 302/306 and flaps 304 can be used. For example, it should be understood that pads 302/306 and flaps 304 can be rectangles, or any other shape or combination thereof.

Figure 4:
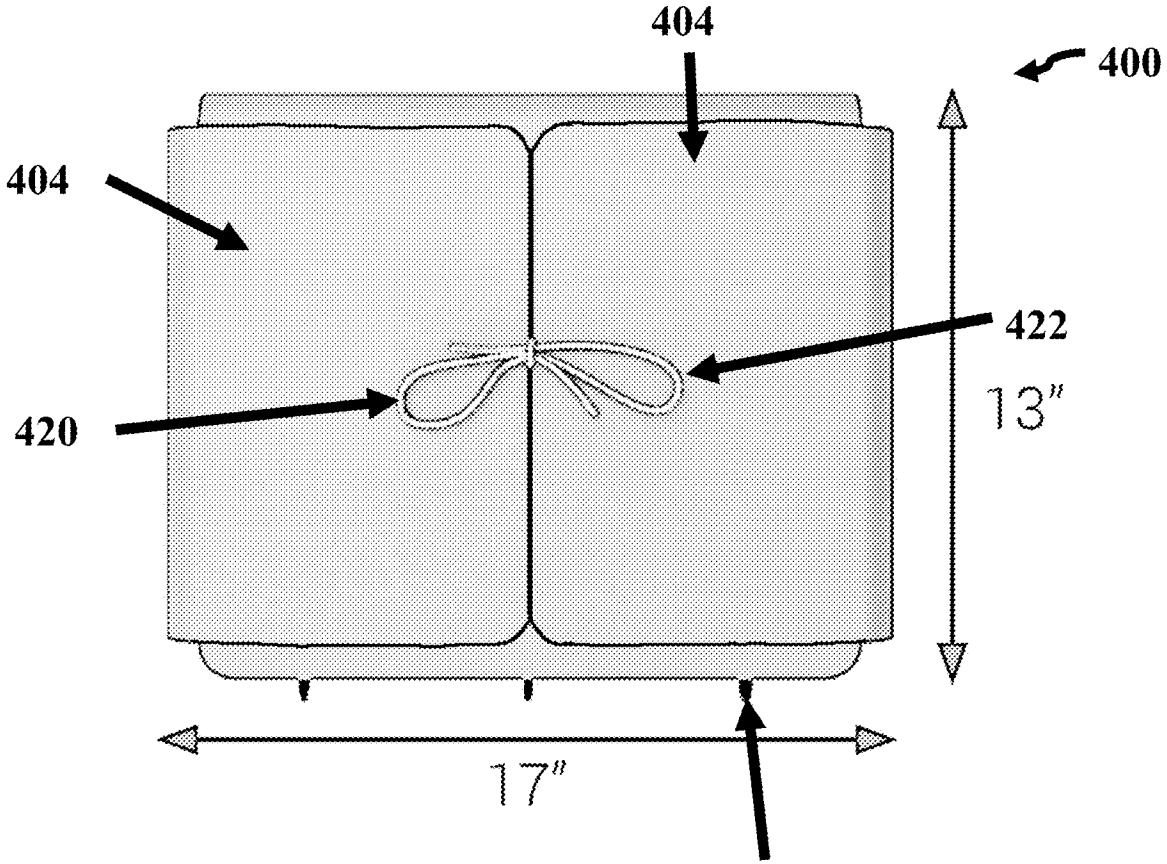
FIG. 4 illustrates an overhead view of an exemplary hair tool case that has hair tools stowed and has been folded.

Shown in FIG. 4 is the hair tool case 400 that has been closed with hair tools enclosed inside. Because the hair tool case 400 is closed, many of the internal components shown in the other figures are not visible in FIG. 4.

As demonstrated in FIG. 4, the flaps 404 are folded inward and the leather lace 420/422 are tied together. Due to how the hair tool case 400 is folded, portions of the power cord 412 are visible. It should be understood that the power cords 412 need not be revealed, and can be entirely enclosed within the hair tool case 400.

An exemplary embodiment of the hair tool case 400 is 17 inches by 13 inches when folded. It should be understood that these sizes, and shapes, are only exemplary.

As can be appreciated, the hair tool case 400 allows multiple tools to not only be stowed safely, but provides them in a small form factor that allows them to be easily transported.

Figure 5:
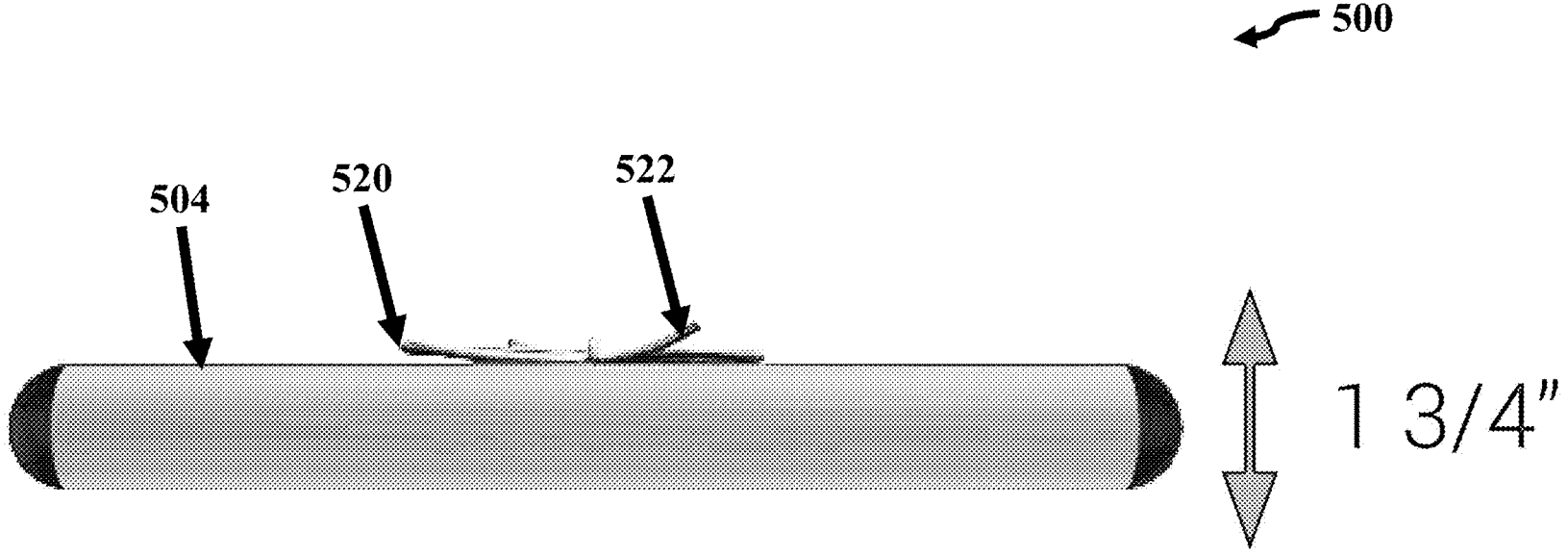
FIG. 5 illustrates a side view of an exemplary hair tool case that has hair tools stowed and has been folded.

FIG. 5 demonstrates a side view of a hair tool case 500 that has three hair tools stowed away for storage and transport. Many components of the hair tool case 500 are not visible in this view, but are illustrated in the other embodiments described as part of this disclosure. As can be seen in FIG. 5, the flaps 504 have been folded over, and the leather lace 520/522 has been tied. An exemplary embodiment of the hair tool case has a height of 1¾ inches when stowed, along with a width of 17 inches and length of 15 inches. These measurements are merely exemplary, and it should be understood that the tool can have any sizing or shapes.

Figure 6:
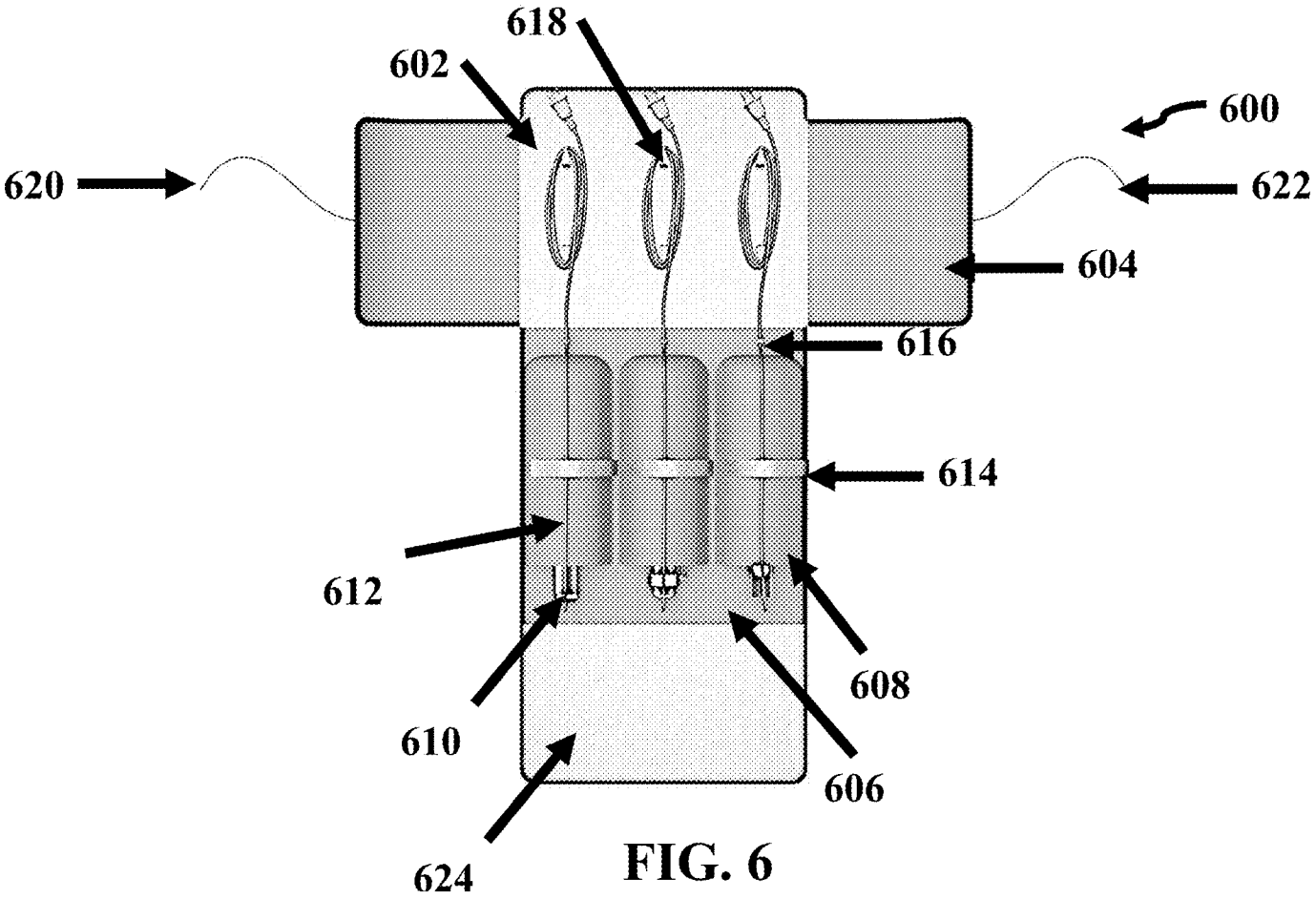
FIG. 6 illustrates an overhead view of an exemplary hair tool case.

FIG. 6 illustrates an overhead view of an exemplary hair tool case 600. FIG. 6 is similar to the embodiment of FIG. 1, but it has a foldable flap 624. Like FIG. 1, FIG. 6 illustrates a first pad 602, flaps 604 that can fold onto and envelope the second pad 606. Hair tool sleeves 608 are affixed to the first pad 602, where the hair tool sleeves 608 house the hair tools 610. As can be seen, the power cord 612 can be wrapped over the tool sleeve 608 and held in place with strap 614. Cable clips 616 allow the power cord 612 to be fixably attached, and the power cord 612 can be wrapped around the cable hooks 618. Leather lace 620/622 allows the flaps 604 to be tied together. The same types of materials described in connection with FIG. 1 can be used with the embodiment of FIG. 6.

The foldable flap 624 is foldable onto the tool sleeves 608. The foldable flap 624 can be made of leather or vinyl, or any other material known in the art. The foldable flap can be made of any mixtures of materials as discussed herein.

Figure 7:
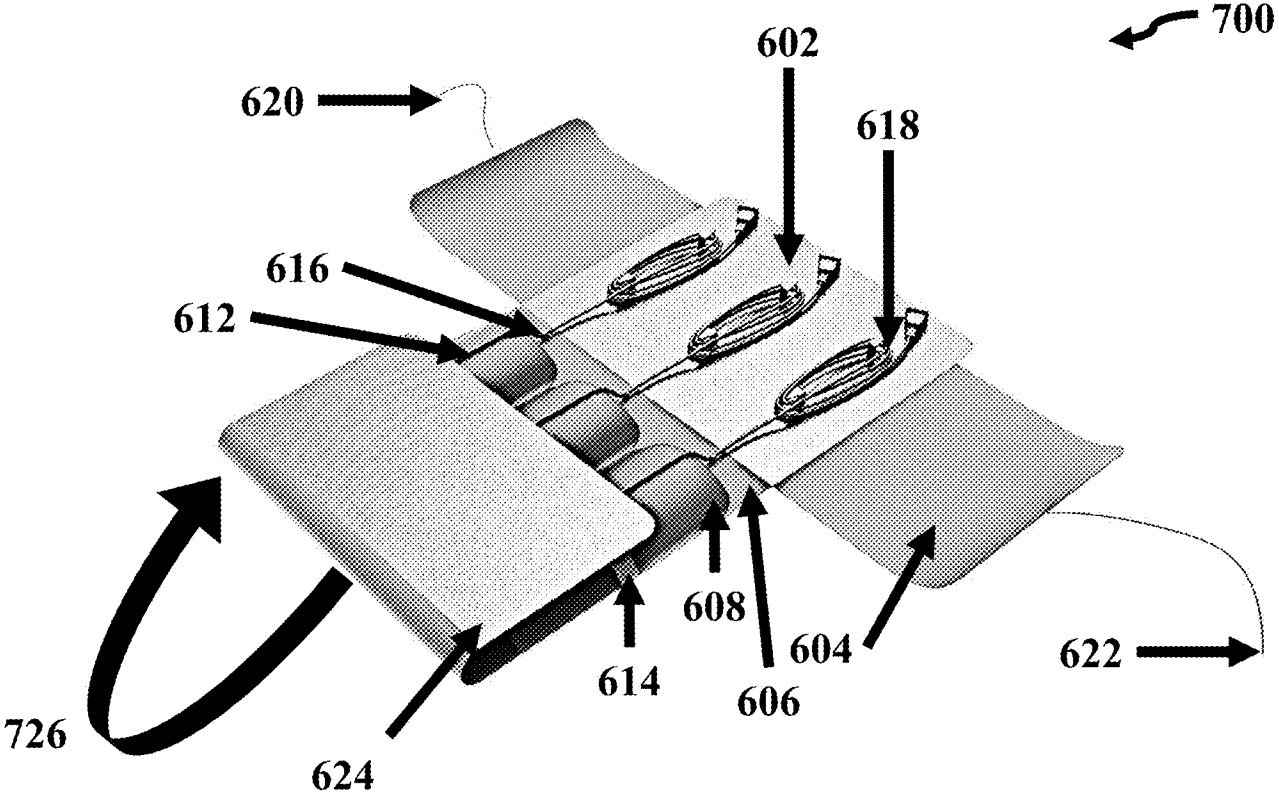
FIG. 7 illustrates an overhead view of an exemplary hair tool case.

FIG. 7 illustrates an overhead view of an exemplary hair tool case 700 having like components as that of FIG. 6. FIG. 7 illustrates the foldable flap 624 folding over and onto the tool sleeves 608. The arrow 726 illustrates the folding of the foldable flap 624.

Figure 8:
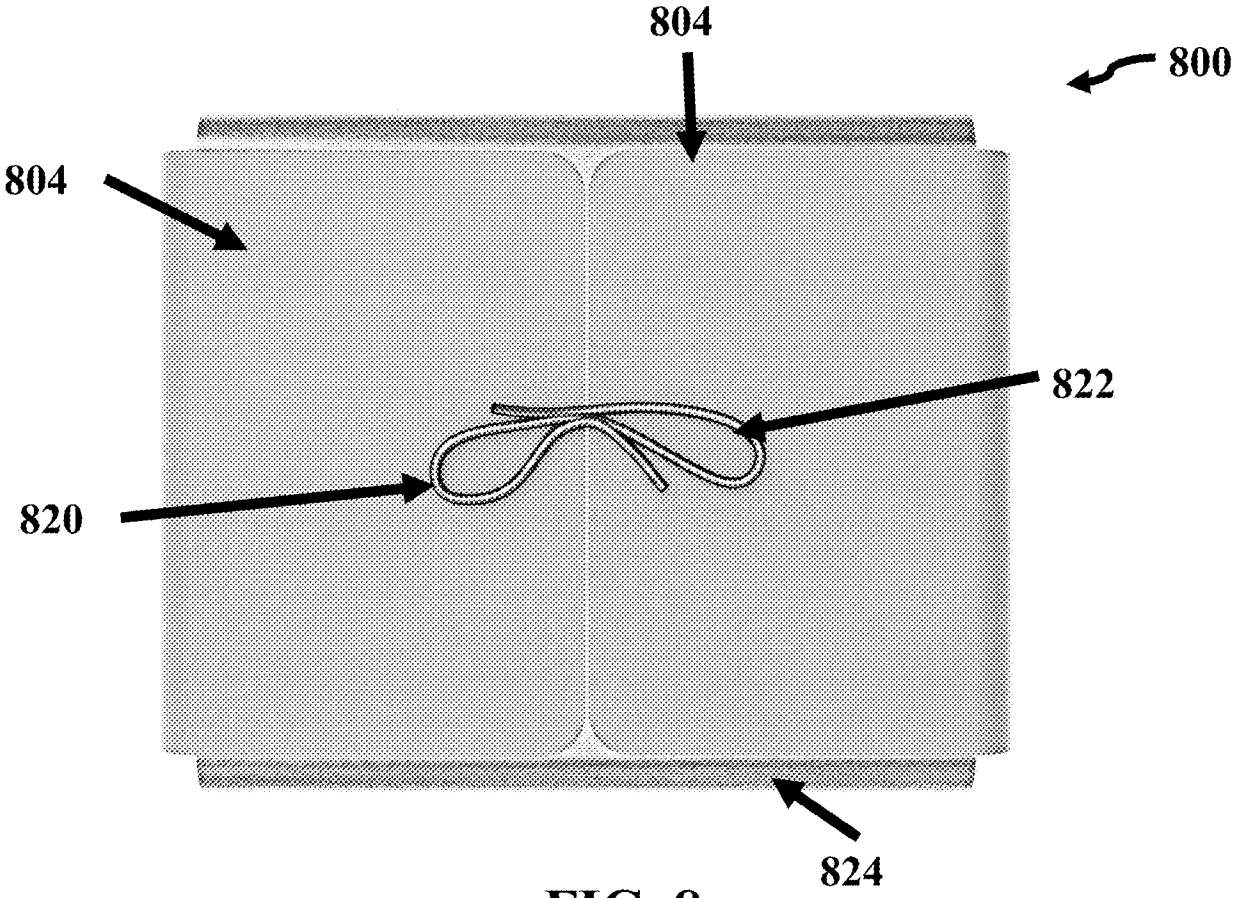
FIG. 8 illustrates an overhead view of an exemplary hair tool case that has hair tools stowed and has been folded.

FIG. 8 illustrates an overhead view of an exemplary hair tool case 800 that has hair tools stowed and has been folded. The hair tool case illustrates the foldable flap 824 folded within the case, along with the flaps 804 being folded on top of the foldable flap 824. The flaps 804 are connected together via the leather lace 820/822.

While this document contains many specifics, these should not be construed as limitations on the scope of the invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few implementations and examples are described, and other implementations, enhancements and variations can be made based on what is described and illustrated in this disclosure.

What is claimed is:

1. A hair tool case comprising:

a first pad;

a second pad, wherein the first pad and second pad are connected to each other and are configured to be foldable onto each other;

one or more tool sleeves attached to the second pad, each of the one or more tool sleeves being configured to house a hair tool;

a first flap and a second flap attached to the first pad, wherein the first and second flap are configured to be folded over to cover the second pad and the first pad when the second pad is folded over the first pad, wherein one end of the first flap is configured to be attached to one end of the second flap;

a strap on the outside of the one or more tool sleeves;

one or more cable clips attached to the second pad; and one or more cable hooks attached to the first pad.

2. The hair tool case according to claim 1 wherein the strap is attached to the second pad at portions in between at least two tool sleeves.

3. The hair tool case according to claim 1 wherein the one or more cable clips are attached to the second pad near an end portion of the one or more tool sleeves.

4. The hair tool case according to claim 1 wherein each of the one or more cable hooks are configured to accommodate a wrapped cable wire.

5. The hair tool case according to claim 1 wherein the first pad is made of vinyl or leather.

6. The hair tool case according to claim 1, further comprising a foldable flap.

7. The hair tool case according to claim 1 wherein the first flap and the second flap are made of leather.

8. The hair tool case according to claim 1 wherein the one end of the first flap is configured to be attached to the one end of the second flap via a leather lace.

9. The hair tool case according to claim 1 wherein the one or more tool sleeves each have a single opening on one end, wherein the other end is closed.

10. A hair tool case comprising:

a pad that is configured to be foldable on itself;

one or more tool sleeves attached to the pad;

a first flap and a second flap attached to the pad, wherein the first and second flap are configured to be folded over to cover a portion of the pad, wherein one end of the first flap is configured to be attached to one end of the second flap;

a strap on the outside of the one or more tool sleeves;

one or more cable clips attached to the pad; and one or more cable hooks attached to the pad.

11. The hair tool case according to claim 10 wherein the strap is attached to the pad at portions in between at least two tool sleeves.

12. The hair tool case according to claim 10 wherein the one or more cable clips are attached to the pad near an end portion of the one or more tool sleeves.

13. The hair tool case according to claim 10 wherein each of the one or more cable hooks are configured to accommodate a wrapped cable wire.

14. The hair tool case according to claim 10 wherein a portion of the pad is made of vinyl or leather.

15. The hair tool case according to claim 10 further comprising a foldable flap.

16. The hair tool case according to claim 10 wherein the first flap and the second flap are made of leather.

17. The hair tool case according to claim 10 wherein the one end of the first flap is configured to be attached to the one end of the second flap via a leather lace.

18. The hair tool case according to claim 10 wherein the one or more tool sleeves each have a single opening on one end, wherein the other end is closed.

19. A tool case comprising:

a pad;

a means to hold hair tools affixed to the pad;

a means to strap power cords to the means to holster hair tools, the means to strap power cords affixed to the pad;

a means to affix a power cord to the pad;

a means to wrap power cords, the means to wrap power cords affixed to the pad; and a means to cover the pad when the pad is folded.

20. The tool case according to claim 19 wherein a portion of the pad is made of vinyl and the means to cover the pad is made of leather.

* * * * *